US008166961B2

(12) United States Patent
Macy

(10) Patent No.: US 8,166,961 B2
(45) Date of Patent: May 1, 2012

(54) OPTIONAL LOADING MECHANISM CAPABLE OF RETROFITTING PAINTBALL ASSEMBLY

(75) Inventor: Omar Alonso Macy, San Jose, CA (US)

(73) Assignee: Real Action Paintball (RAPU), Inc., San Jose, CA (US)

( * ) Notice: Subject to any disclaimer, the term of this patent is extended or adjusted under 35 U.S.C. 154(b) by 38 days.

(21) Appl. No.: 12/882,190

(22) Filed: Sep. 14, 2010

(65) Prior Publication Data

US 2012/0060809 A1 Mar. 15, 2012

(51) Int. Cl.
*F41B 11/00* (2006.01)

(52) U.S. Cl. ..... 124/73

(58) Field of Classification Search ..... 124/73
See application file for complete search history.

(56) References Cited

U.S. PATENT DOCUMENTS

| | | | | |
|---|---|---|---|---|
| 5,503,137 | A | 4/1996 | Fusco | |
| 6,532,946 | B1 * | 3/2003 | Paquette | 124/49 |
| 7,765,999 | B1 * | 8/2010 | Stephens et al. | 124/73 |
| 2005/0028801 | A1 * | 2/2005 | Lewis | 124/45 |
| 2006/0169268 | A1 | 8/2006 | Tippmann, Jr. | |
| 2007/0181117 | A1 | 8/2007 | Tippmann, Jr., et al. | |
| 2008/0295818 | A1 * | 12/2008 | Styles et al. | 124/83 |

* cited by examiner

*Primary Examiner* — Troy Chambers
(74) *Attorney, Agent, or Firm* — James M. Wu; JW Law Group

(57) ABSTRACT

A retrofit kit for providing flexible paintball loading mechanism is disclosed. In one embodiment, the retrofit kit includes a right side portion of a receiver, a left side portion of the receiver, and a bottom removable adapter. The right side portion of a receiver having a first feed hatch is able to receive paintballs through an upper loading mechanism. The left side portion of the receiver after coupling with the right side portion of the receiver to form a receiver is capable of coupling to a barrel as well as a pressured gas container. The bottom removable adapter, in one embodiment, facilitates to receive paintballs via a bottom feeding mechanism.

20 Claims, 17 Drawing Sheets

548

OPTIONAL LOADING MECHANISM CAPABLE OF RETROFITTING PAINTBALL ASSEMBLY

FIELD

The present invention relates to paint ball guns. More specifically, the present invention relates to paint ball and/or projectile feed systems.

BACKGROUND

With increasing popularity of paintball tournaments as well as professional trainings such as military and sports trainings, more accurate and realistic looking paintball guns or markers are in demand. For example, the success of training or competition depends on how quickly an operator of a paintball marker can eliminate opponents by hitting them with paintballs or paint projectiles. A problem associated with a conventional paintball marker or gun is that the accuracy of paintball marker is relatively poor partially due to the traditional design of the paintball guns or markers.

A conventional paintball gun or marker, for example, typically loads paintballs from a hopper into the paintball gun via a gravitational force. The hopper, which is mounted on the top of paintball guns or receiver, typically obstructs aiming capability of an operator. An operator usually has a difficult time taking proper aim via a front sight on the barrel.

Another problem associated with a conventional paintball marker or gun with a hopper mounted on top of the receiver is that a typical paintball gun deviates from a real gun whereby using paintball marker as training exercise degrades the effectiveness of military and/or police field training.

SUMMARY OF THE INVENTION

Embodiments of the present invention disclose a retrofit kit providing flexible paintball loading mechanism for a paintball gun. In one embodiment, the retrofit kit includes a right side portion of a receiver, a left side portion of the receiver, and a bottom removable adapter. The right side portion of a receiver having a first feed hatch is able to receive paintballs through an upper loading mechanism. The left side portion of the receiver, after coupling with the right side portion of the receiver to form a receiver, is capable of coupling to a barrel as well as a pressured gas container. The bottom removable adapter, in one embodiment, facilitates to receive paintballs via a bottom feeding mechanism. In one example, the kit further includes a right grip portion able to couple to the right side portion of the receiver and a left grip portion able to couple to the left side portion of the receiver for gripping.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
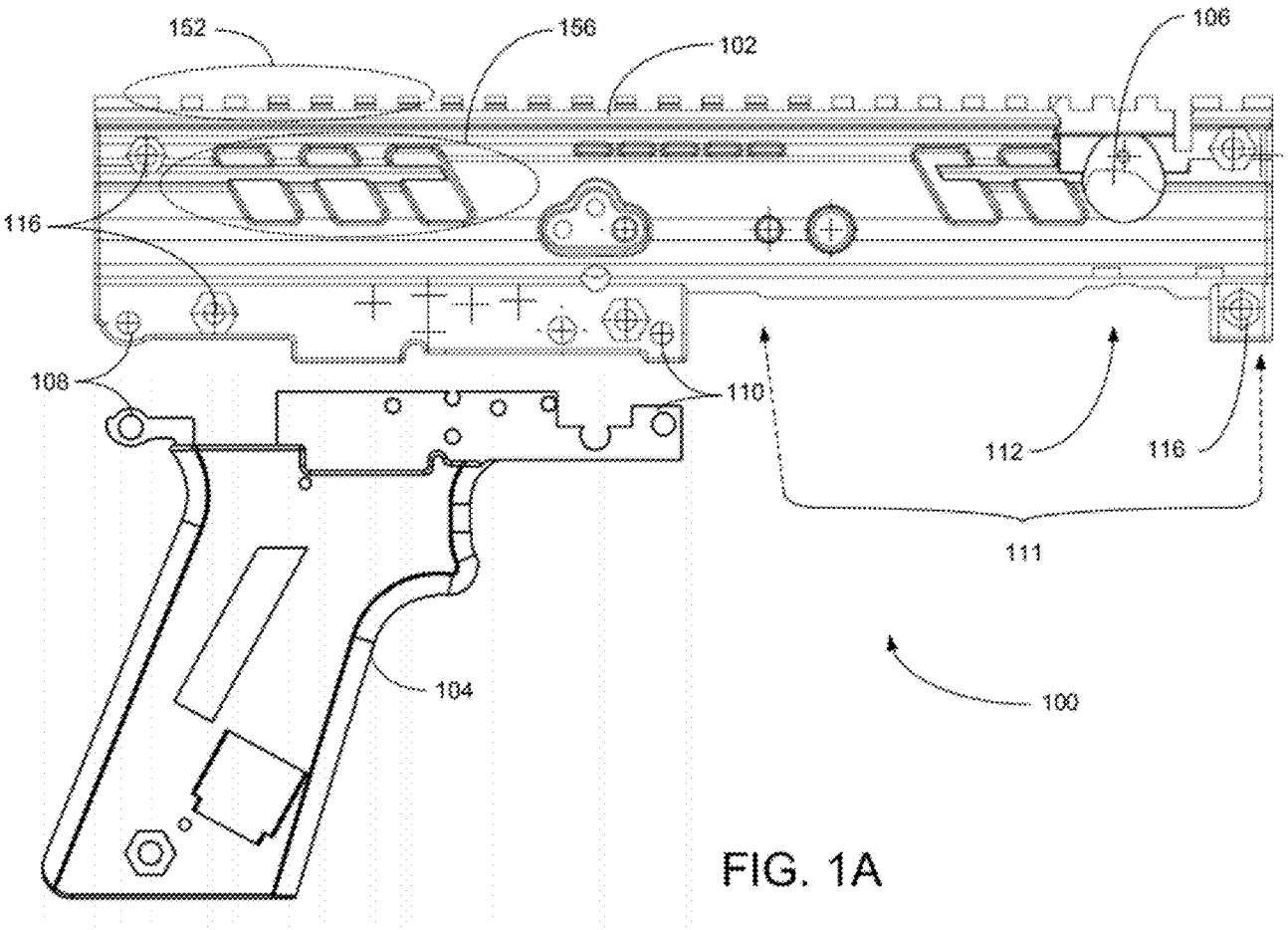
FIGS. 1A-D are diagrams illustrating a right side receiver in accordance with one embodiment of the present invention.

Exemplary embodiment(s) of the present invention is described herein in the context of a method, system and apparatus of retrofitting a paintball propelling device with a receiver capable of facilitating optional paintball feed mechanisms.

Those of ordinary skills in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment (s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Embodiments of the present invention disclose a retrofit kit providing flexible paintball loading mechanism for a paintball gun. In one embodiment, the retrofit kit includes a right side portion of a receiver, a left side portion of the receiver, and a bottom removable adapter. The right side portion of a receiver having a first feed hatch is able to receive paintballs through an upper loading mechanism. The left side portion of the receiver, after coupling with the right side portion of the receiver to form a receiver, is capable of coupling to a barrel as well as a pressured gas container. The bottom removable adapter, in one embodiment, facilitates to receive paintballs via a bottom feeding mechanism. In one example, the kit further includes a right grip portion capable of coupling to the right side portion of the receiver and a left grip portion capable of coupling to the left side portion of the receiver for gripping.

FIG. 1A is a diagram 100 illustrating a right side receiver in accordance with one embodiment of the present invention. Diagram 100 includes a right side receiver 102 and a right side portion of a grip 104. Receiver, assembly, body, or frame 102 of a paintball marker or gun is part of physical structure that houses various mechanical and/or operating parts or components. The terms "receiver," "body," "assembly," and "frame" are hereinafter used interchangeably. Right side receiver 102, in one aspect, can be fabricated or casted with solid or rigid materials which can stand a range of predefined stresses as well as temperature variations. The materials include, but not limited to, metal, aluminum, polymers, alloy, composite plastics, and the like. It should be noted that the underlying concept of the exemplary embodiment(s) of the present invention would not change if one or more components (or elements) were added to or removed from diagram 100.

Right side receiver 102, in one embodiment, includes an opening 106 for top loading or top feed paintballs and a cut-out area 111 configured to couple to a bottom feed adapter. Opening 106, in one aspect, can be selectively closed by a hatch, a cover, or a door when the top feed mechanism of paintballs is not used. Paintballs are considered as ammunition for the paintball gun or marker and they, for example, are round or spherical shaped capsules containing dye substances. Upon an impact of a paintball, the paintball leaves a colored marker. The bottom feed adapter, which is not shown in FIG. 1A and will be discussed more detail later, includes a bottom feed port 112 which facilitates bottom feed mechanism of paintballs. Right side receiver 102 further includes various holes 116 for fastening purposes.

Grip or handle 104, in one embodiment, is an optional component facilitating gripping and/or handling. Depending on the applications, grip 104 may or may not be mounted. Applications may vary depending on which existing paintball marker is to be retrofitted. When grip 104 is desirable, grip 104 can be mounted onto right side receiver 102 using mounting holes 108-110. It should be noted that fasteners such as screws and bolts can be used to secure grip 104 onto right side receiver 102 via holes 108-110. Grip 104 is fabricated or casted with solid or rigid materials capable of facilitating handling comfort. The solid or rigid materials include wood, rubber, metal, aluminum, polymers, alloy, composite plastics, and the like.

It should be noted that various other features such as knock-outs 156 and grooves 152 are relating to aesthetic and/or other functional values whereby they do not alter the underlying concept of the exemplary embodiment(s) of the present invention if the shape of knock-outs or a groove changes.

Figure 1B:
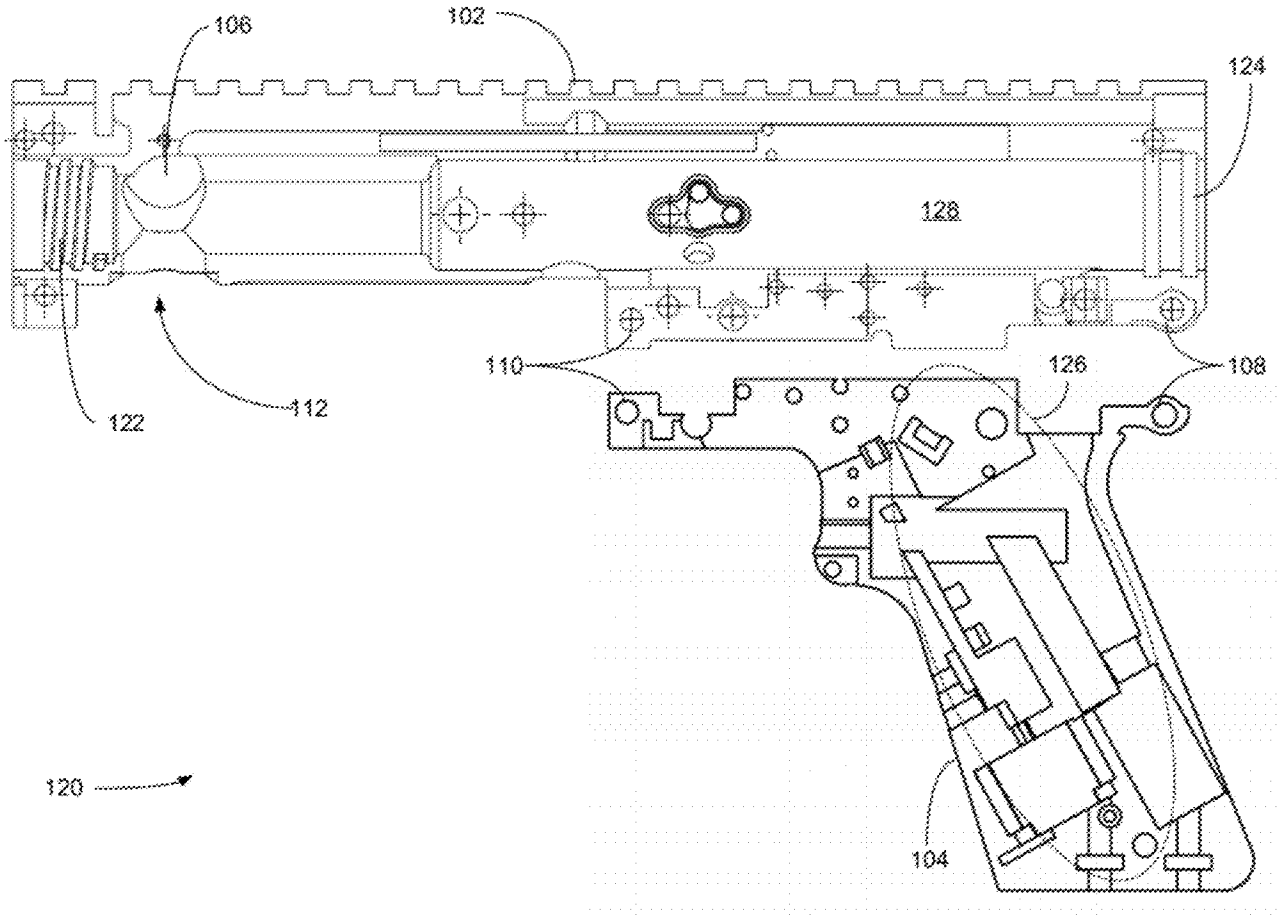

FIG. 1B is a diagram 120 illustrating a right side internal view of a receiver in accordance with one embodiment of the present invention. Diagram 120 includes a right side internal view of a receiver 102 and a right side portion internal view of a grip 104. The right side internal view of receiver 102 includes a barrel coupling system 122, a recess 128, and a rear coupling system 124. Barrel coupling system 122, in one example, includes a coupling device as such threads configured to couple with a barrel. Recess 128 is used to house a propelling mechanism while rear coupling system 124 may be used to couple an end cap, a buttstock, or a compressed air tank. Right side portion internal view of a grip 104, in one embodiment, includes various mechanical or circuitry elements 126 such as battery. It should be noted that the underlying concept of the exemplary embodiment(s) of the present invention would not change if one or more components (or elements) were added to or removed from diagram 120.

Figure 1C:
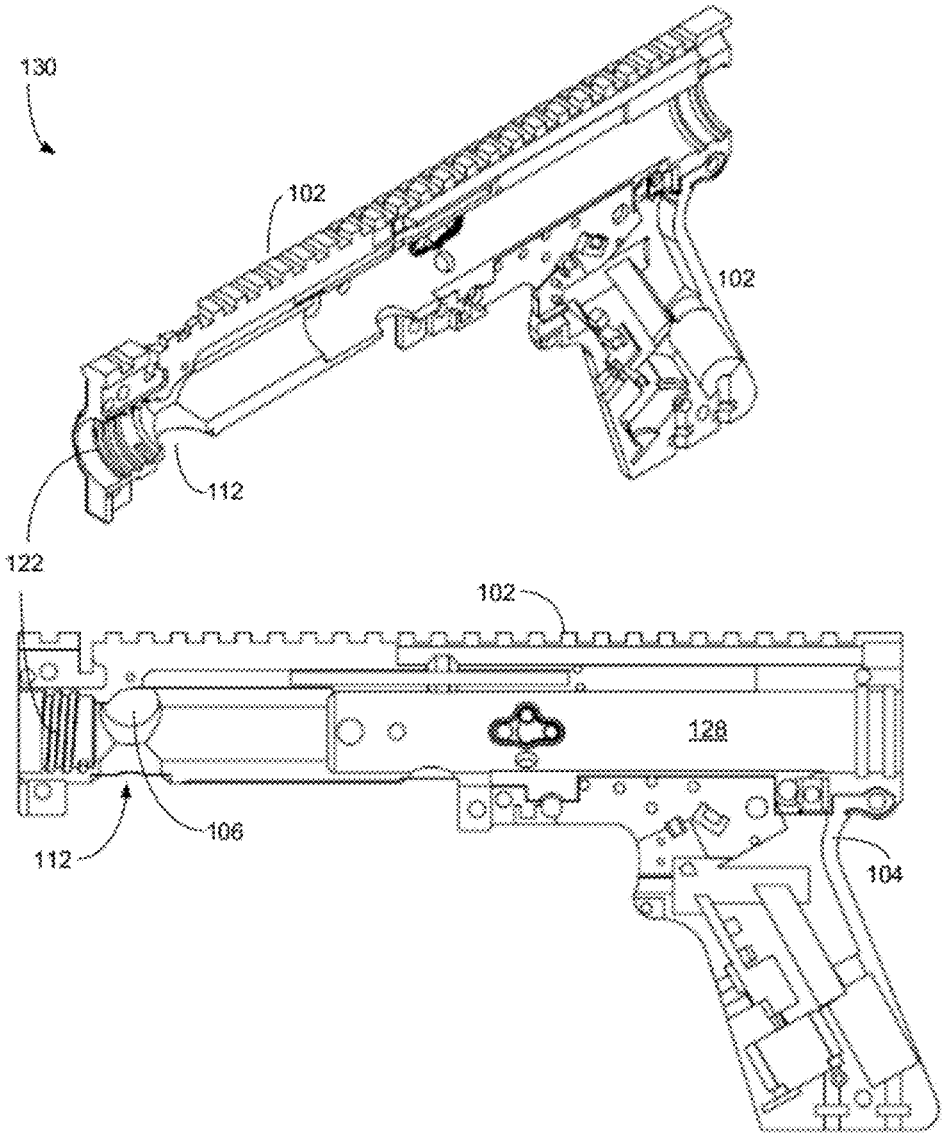

FIG. 1C is a diagram 130 illustrating a right side internal view of a receiver in accordance with one embodiment of the present invention. Diagram 130 illustrates right side receiver 102 mounted with grip 104. The right side internal view of receiver 102 includes a barrel coupling system 122, a recess 128, and a rear coupling system 124.

Figure 1D:
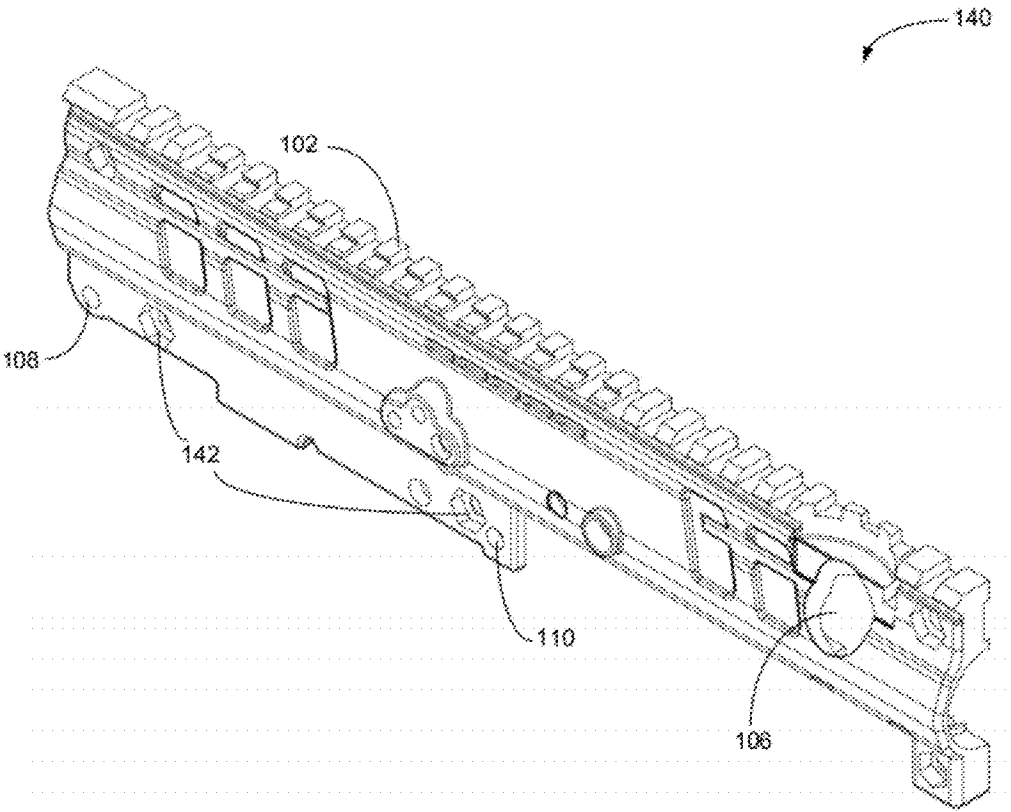

FIG. 1D illustrates a three dimensional ("3D") diagram 140 showing a right side receiver in accordance with one embodiment of the present invention. Diagram 140 illustrates right side receiver 102 without a grip mounted. It should be noted that the underlying concept of the exemplary embodiment(s) of the present invention would not change if one or more components (or elements) were added to or removed from diagram 140.

Figure 2A:
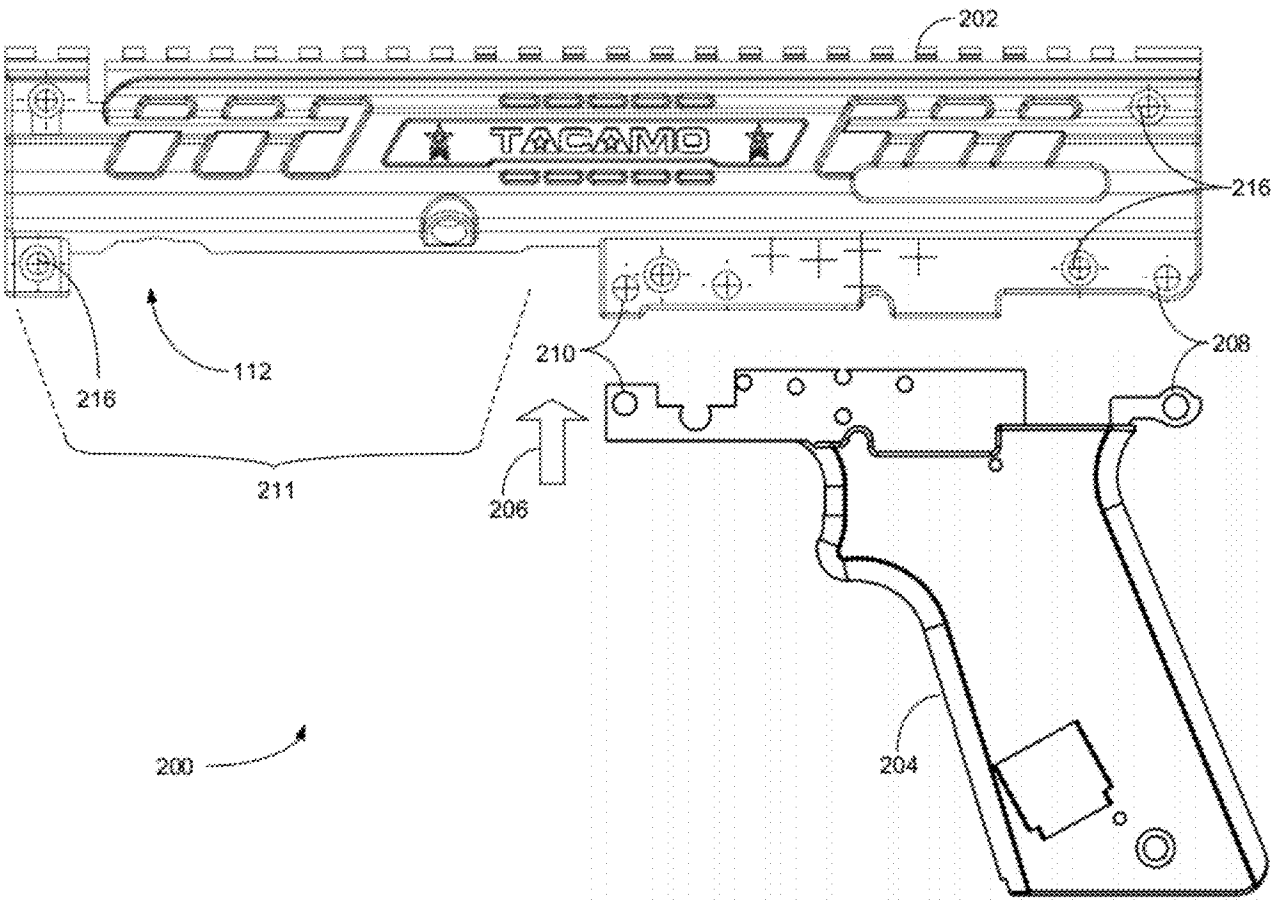
FIGS. 2A-B are diagrams illustrating a left side receiver in accordance with one embodiment of the present invention.

FIG. 2A is a diagram 200 illustrating a left side receiver in accordance with one embodiment of the present invention. Diagram 200 includes a left side receiver 202 and a left side portion of a grip 204. Similar to right side of a right side receiver 102, left side receiver 202 is fabricated or casted with solid or rigid materials which can withhold a range of predefined pressure stress as well as temperature variations. The materials include, but not limited to, metal, aluminum, polymers, alloy, composite plastics, and the like. It should be noted that the underlying concept of the exemplary embodiment(s) of the present invention would not change if one or more components (or elements) were added to or removed from diagram 200.

Left side receiver 202, in one embodiment, includes a cut-out area 211 configured to couple to a bottom feed adapter. The bottom feed adapter, not shown, couples to both right side receiver 102 and left side receiver 202. The adapter, which will be discussed more detail later, includes a bottom feed port 112 capable of facilitating bottom feed mechanism of paintballs. Left side receiver 202 further includes various holes 216 for fastening purposes.

Left side portion of grip 204, in one embodiment, is an optional component facilitating hand gripping and/or handling. Depending on the applications, grip 204 may or may not be mounted onto left side receiver 202. When left side portion of grip 204 is desirable, left side portion of grip 204 can be mounted onto left side receiver 202 using mounting holes 208-210. It should be noted that fasteners such as screws and bolts may be used to secure grip 104 onto left side receiver 202 via holes 208-210. Left side portion of grip 204 can be fabricated or casted with solid or rigid materials capable of facilitating hand holding or griping. The solid or rigid materials include wood, rubber, metal, aluminum, polymers, alloy, composite plastics, and the like.

Figure 2B:
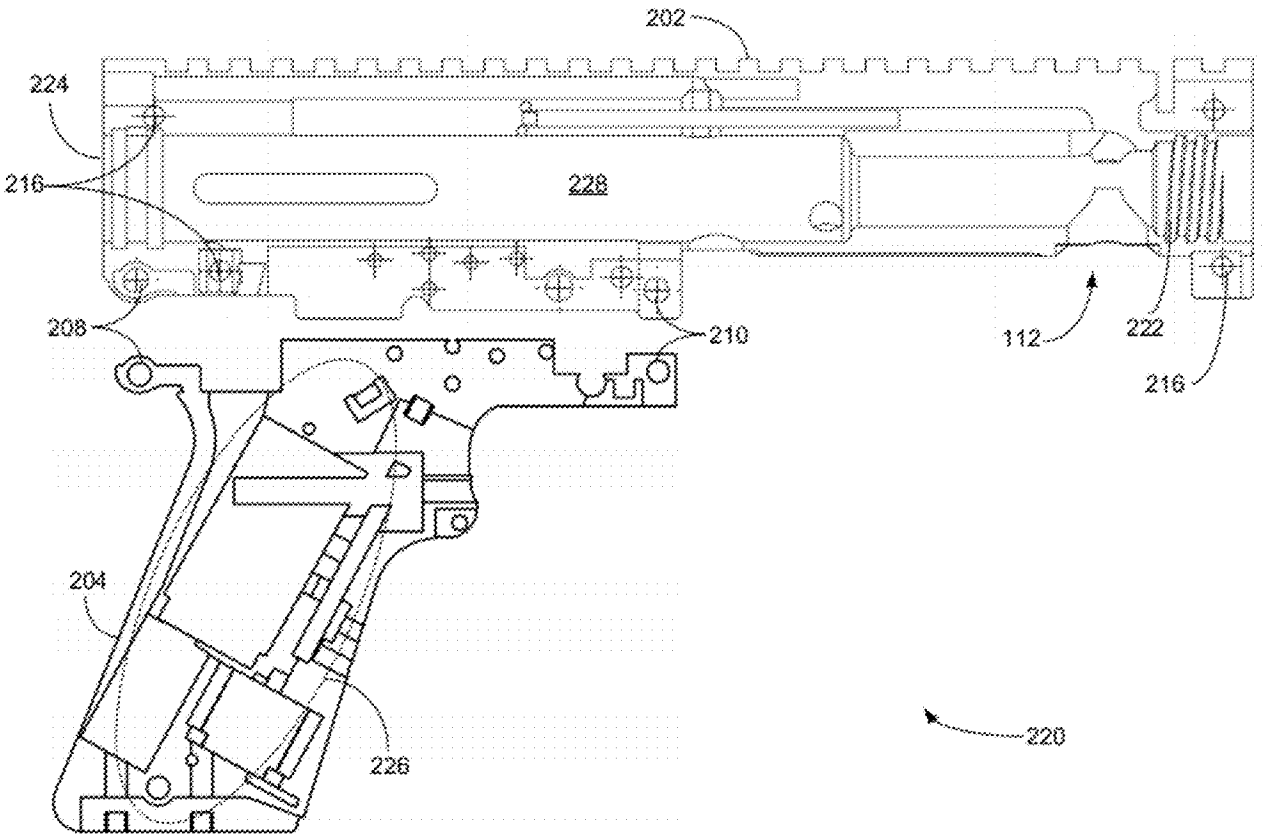

FIG. 2B is a diagram 220 illustrating a left side internal view of a receiver in accordance with one embodiment of the present invention. Diagram 220 includes a left side internal view of a receiver 202 and a left side portion internal view of a grip 204. Left side internal view of receiver 202 includes a barrel coupling system 222, a recess 228, and a rear coupling system 224. Barrel coupling system 222, in one example, includes a coupling device as such threads configured to couple with a barrel. Recess 228 is used together with recess 128 to house a propelling mechanism while rear coupling system 224 may be used to couple an end cap, a buttstock, or a compressed air tank. Light side portion internal view of a grip 204, in one embodiment, includes various mechanical or circuitry elements 226.

Figure 3A:
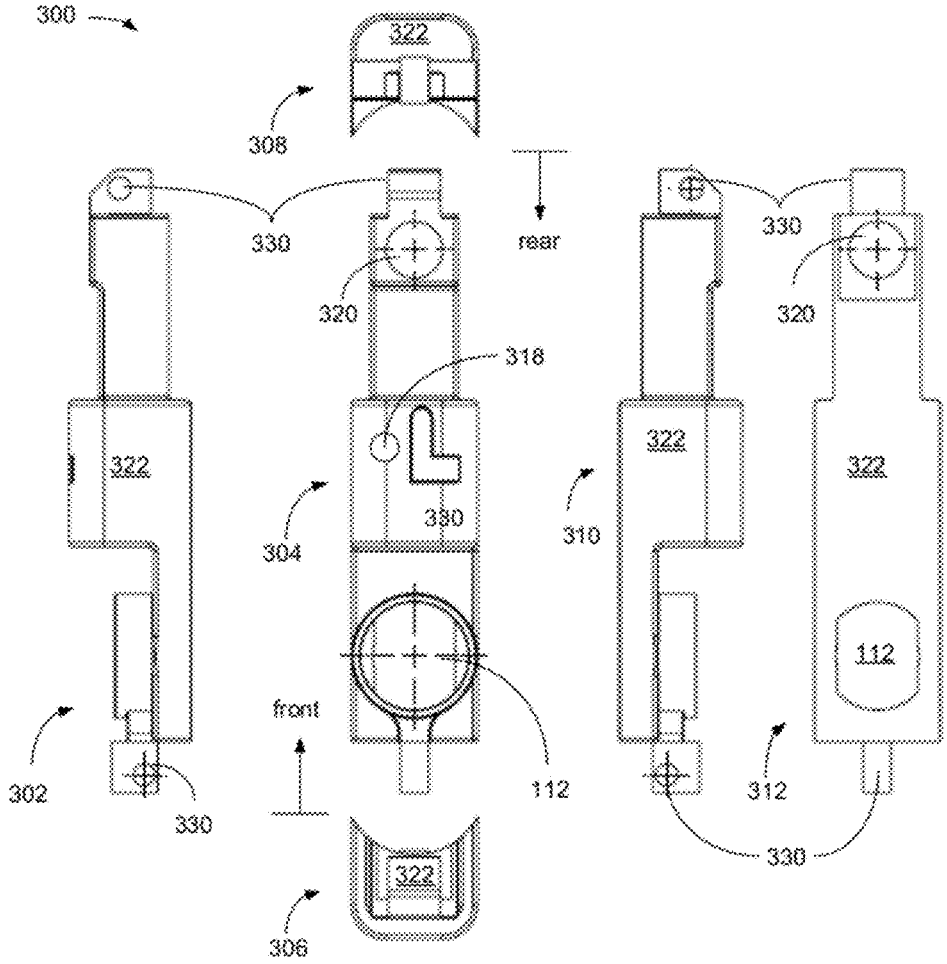
FIGS. 3A-B are diagrams illustrating a bottom feed adapter in accordance with one embodiment of the present invention.

FIG. 3A is a set of diagrams 300 illustrating various views of bottom feed adapter in accordance with one embodiment of the present invention. FIG. 3A illustrates a left view 302 of bottom feed adapter 322, top view 304 of bottom feed adapter 322, right view 310 of bottom feed adapter 322, bottom view 312 of bottom feed adapter 322, front view 306 of bottom feed adapter 322, and rear view 308 of bottom feed adapter 322. Bottom feed adapter 322, in one embodiment, includes a bottom feed port 112, a gas port 320, and an optical lighting device 318. It should be noted that the underlying concept of the exemplary embodiment(s) of the present invention would not change if one or more components (or elements) were added to or removed from diagram 300.

Bottom feed port 112, in one embodiment, is an opening having a predefined dimension that allows conventional paintballs to pass through. When bottom feed adapter 322 is coupled to a bottom feed magazine (not shown in FIG. 3A), the bottom feed magazine, which is powered by a bottom feed mechanism, generates a force which is in a direction opposite from the gravitation force to push a paintball from the magazine into a receiver of paintball gun through bottom feed port 112. After the paintball in the receiver is fired or released, optical lighting device 318 emits an optical signal or light instructing the magazine to feed another paintball to the receiver through bottom feed port 112.

Figure 3B:
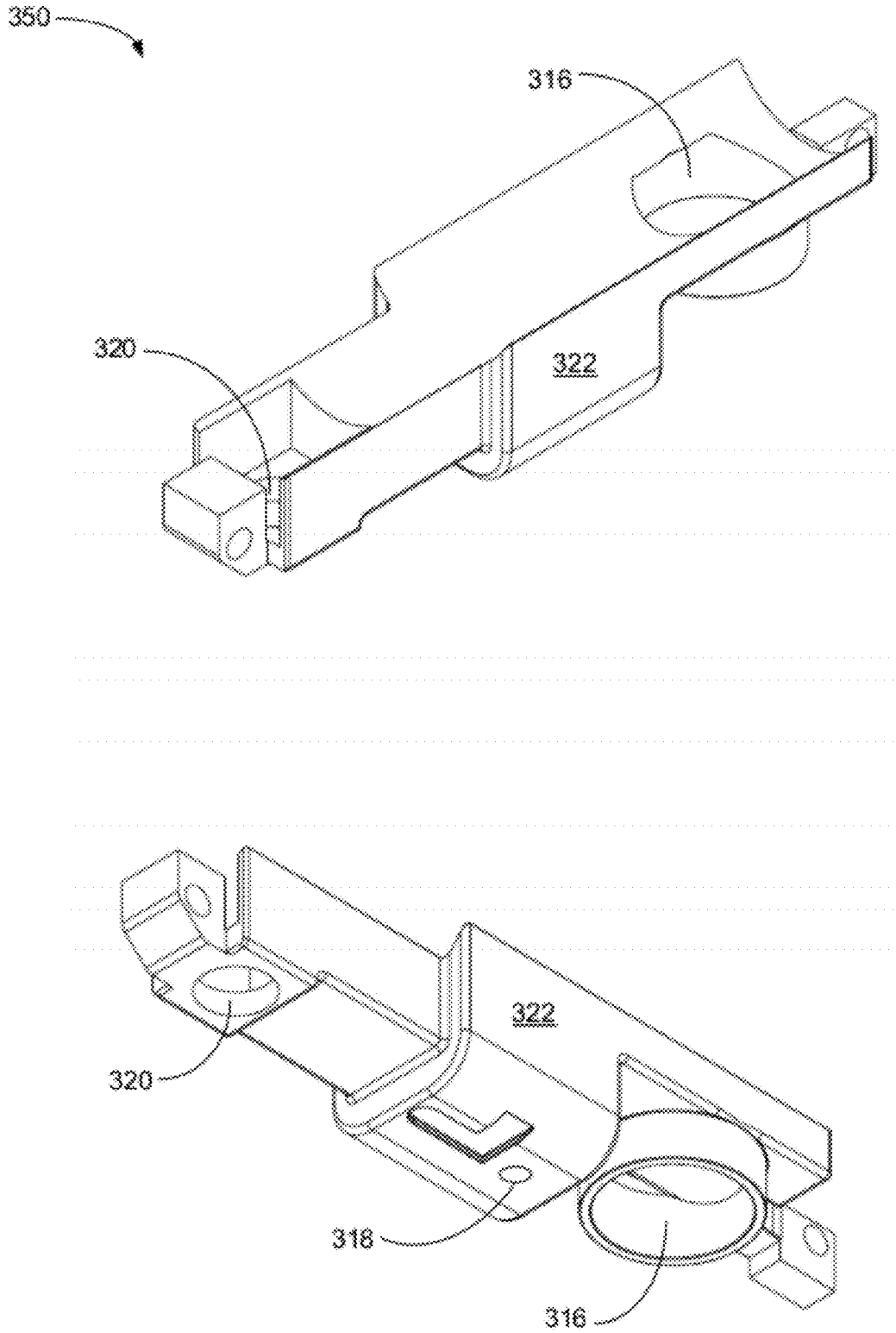

Bottom feed adapter 322, in one embodiment, is coupled to left and right sides of receiver to form a complete receiver that is capable of retrofitting an existing paintball marker or gun. Various attaching elements 330 are used to fasten bottom feed adapter 322 to left and right side receiver. It should be noted that the dimension of bottom feed adapter may vary depending on the applications. FIG. 3B illustrates three dimensional drawings of bottom feed adapter with different viewing angles in accordance with one embodiment of the present invention. Note that depending on the applications, the shape and design of bottom feed adapter may vary slightly.

Figure 4:
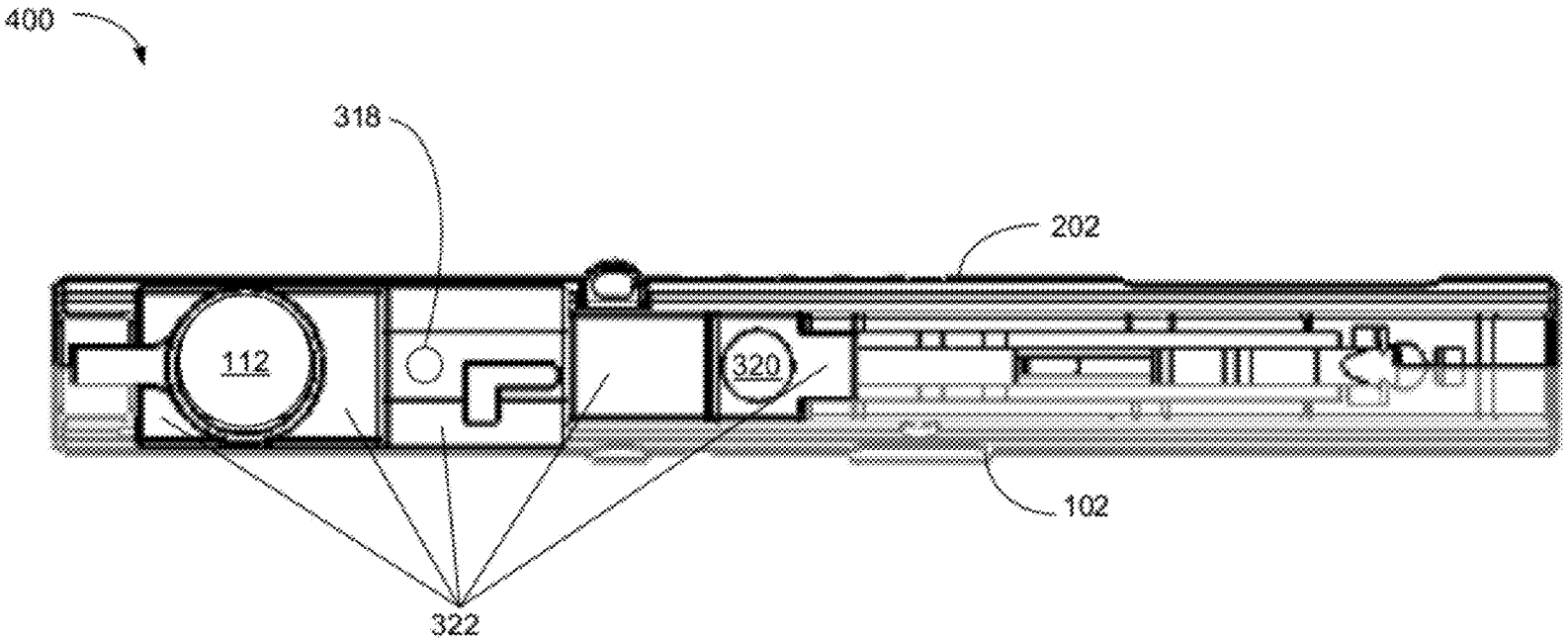
FIG. 4 is a diagram illustrating a bottom view of a receiver including a bottom feed adapter in accordance with one embodiment of the present invention.

FIG. 4 is a diagram 400 illustrating a bottom view of a receiver capable of facilitating bottom feed mechanism in accordance with one embodiment of the present invention. Diagram 400 shows a bottom view of a receiver including right side receiver 102, left side receiver 202, and a bottom feed adapter 322. While bottom feed port 112 facilitates paintball passage from bottom feed magazine to the receiver, gas port 320 coupled to a gas line receiving pressurized gas from a compressed air or nitrogen tank, not shown in FIG. 4.

Figure 5A:
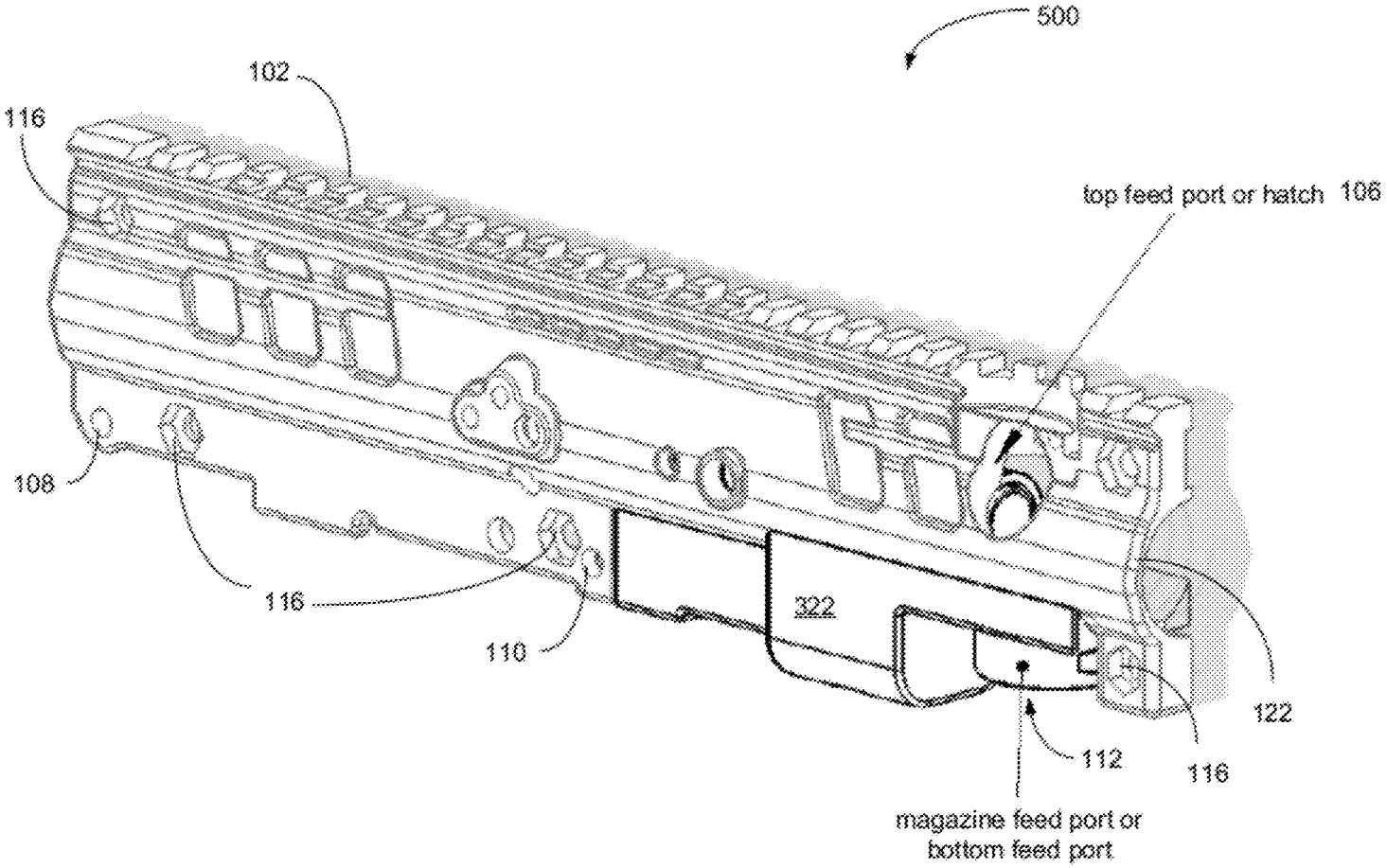
FIGS. 5A-E are diagrams illustrating perspective view of a receiver having a bottom feed adapter mounted to the receiver in accordance with one embodiment of the present invention.

FIG. 5A is a 3D diagram 500 illustrating a perspective view of a receiver in accordance with one embodiment of the present invention. Diagram 500, in one aspect, illustrates a right side receiver 102 having bottom feed adapter 322 capable of accepting paintballs fed from the bottom feed magazine, not shown. Holes 116 are used to fasten with the left side receiver, not shown, to form a complete receiver. Right side receiver 102 also includes a top feed port or hatch 106 capable of accepting paintballs fed from a container or hopper situated above right side receiver 102. It should be noted that the underlying concept of the exemplary embodiment(s) of the present invention would not change if one or more components (or elements) were added to or removed from diagram 500.

Figure 5B:
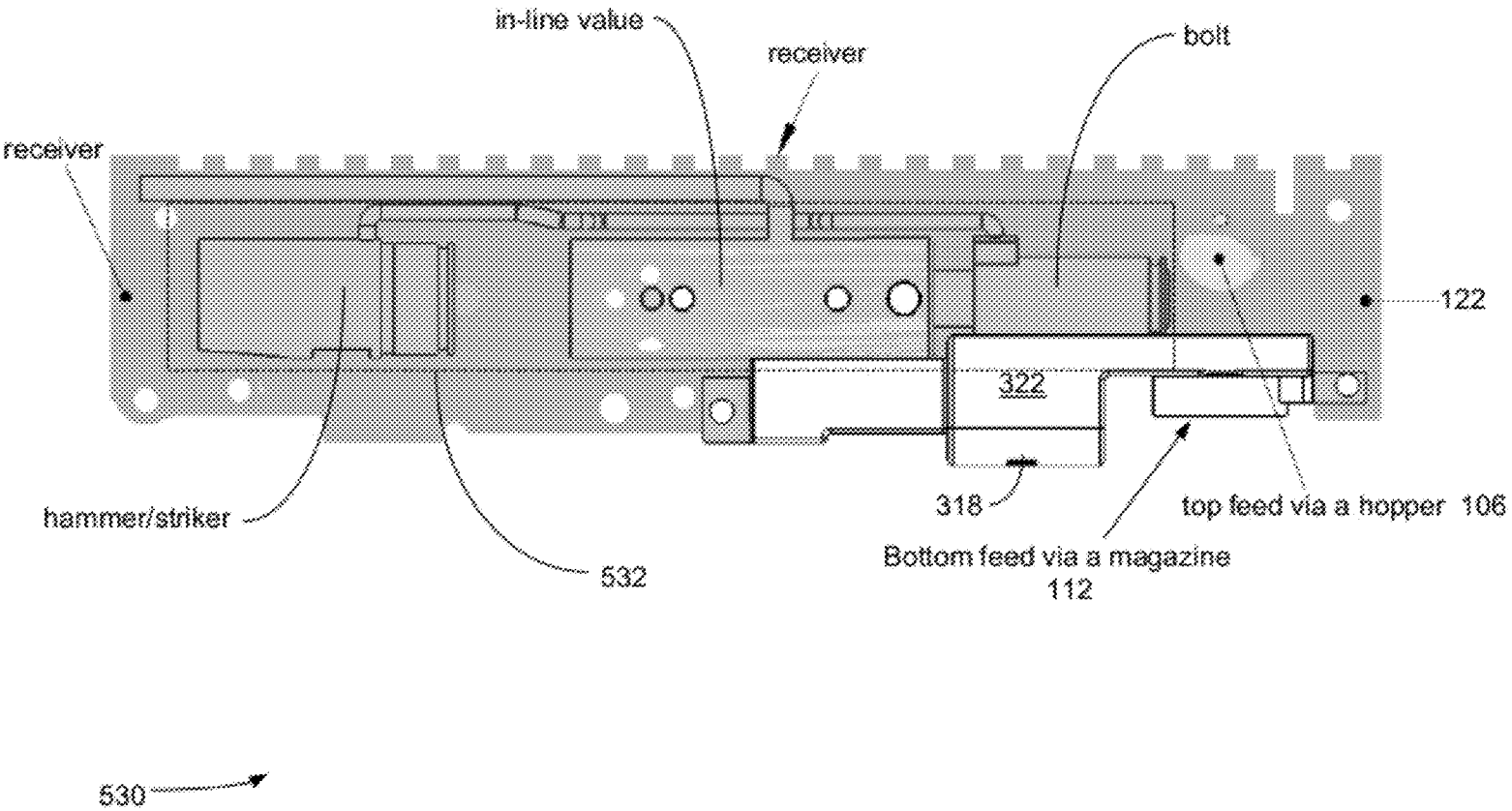
Figure 5C:
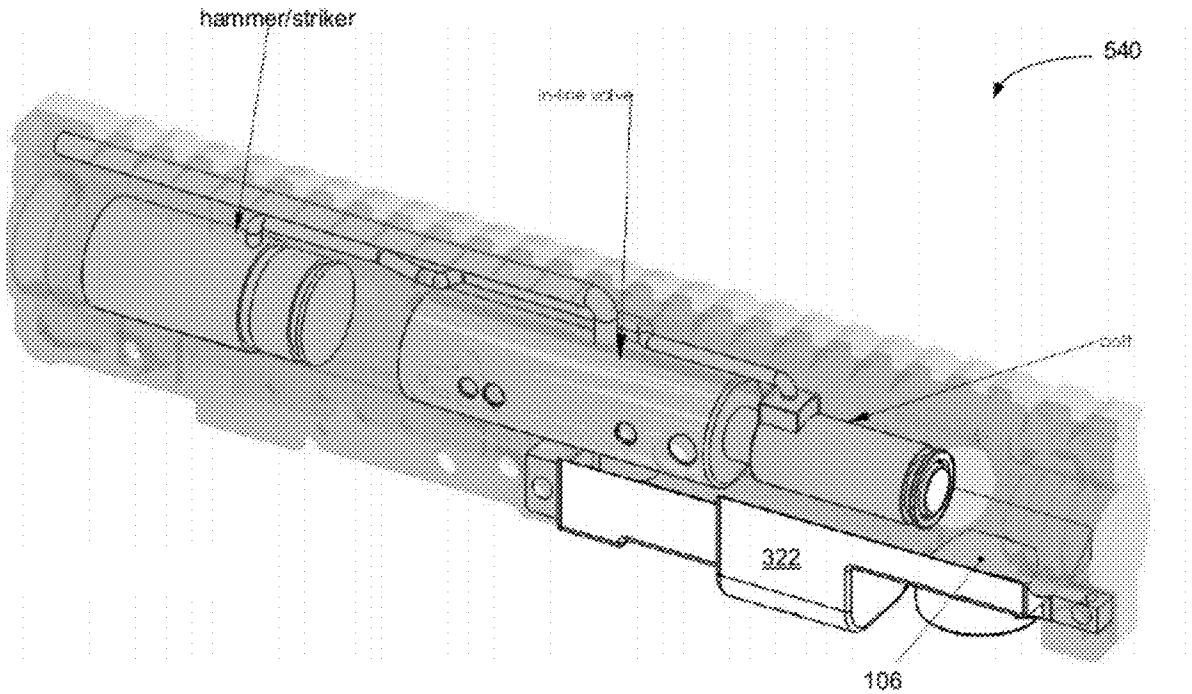

FIG. 5B illustrates an internal perspective view of a receiver and FIG. 5C illustrates a 3D internal perspective view of a receiver 540 in accordance with one embodiment of the present invention. Diagram 500 includes a projectile propelling system 532 and a bottom feed adapter 322 mounted to the receiver. In one embodiment, the receiver is capable of accept top feed mechanism via opening 106. Alternatively, the receiver can select bottom feed mechanism via bottom feed port 112. Depending on the applications, a paintball operator can selectively choose between top and bottom feed mechanisms. Note that both top and bottom feed mechanisms are able to deliver a paintball in the chamber of receiver when it is empty.

Projectile propelling system 532 includes hammer or striker, in-line value, and a bolt. In one embodiment, various traditional projectile propelling systems may be retrofitted with embodiments of the present disclosed retrofit kit whereby the retrofitted paintball guns are able to accept loading from the bottom feed as well as the top feed. When an operator pulls the trigger of a paintball marker, the pressure unlatches the hammer from the bolt and the projectile (i.e., paintball) is propelled.

Figure 5D:
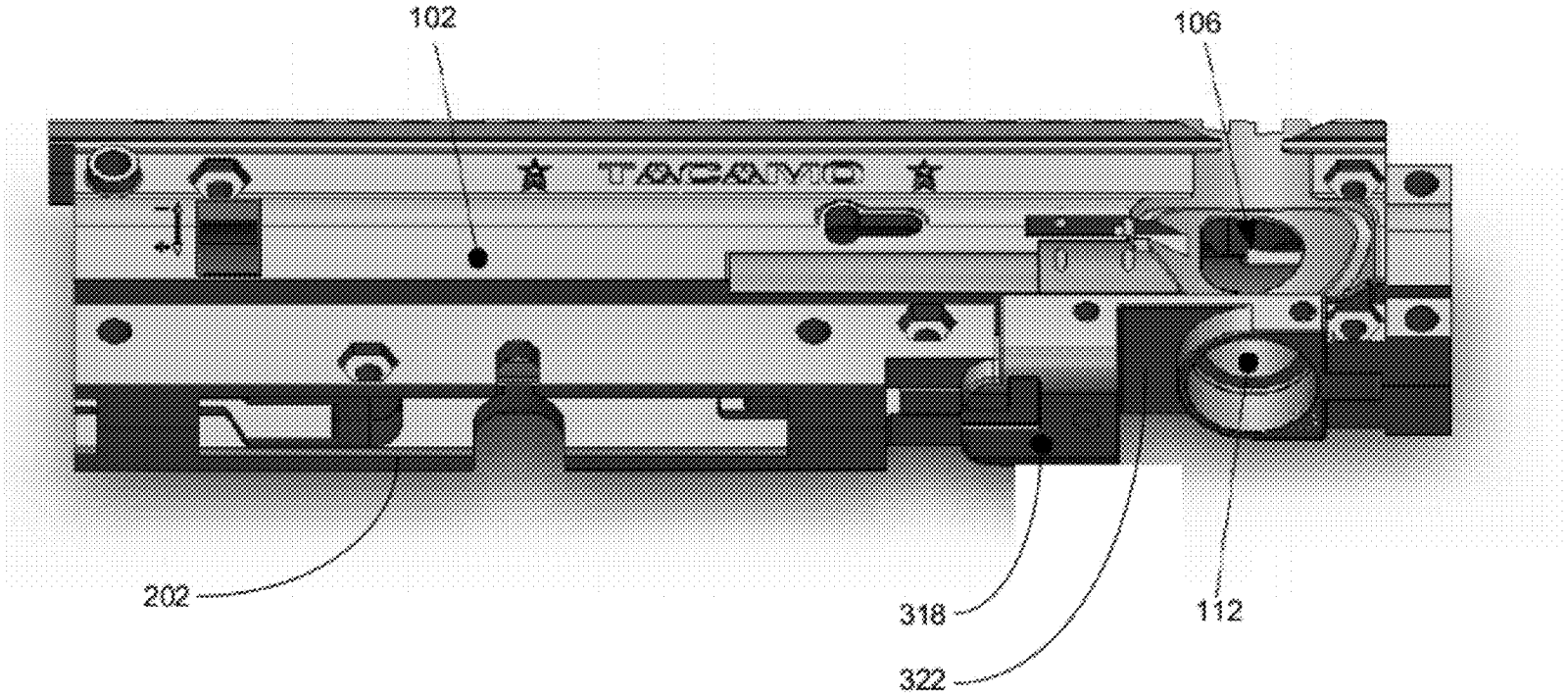
Figure 5E:
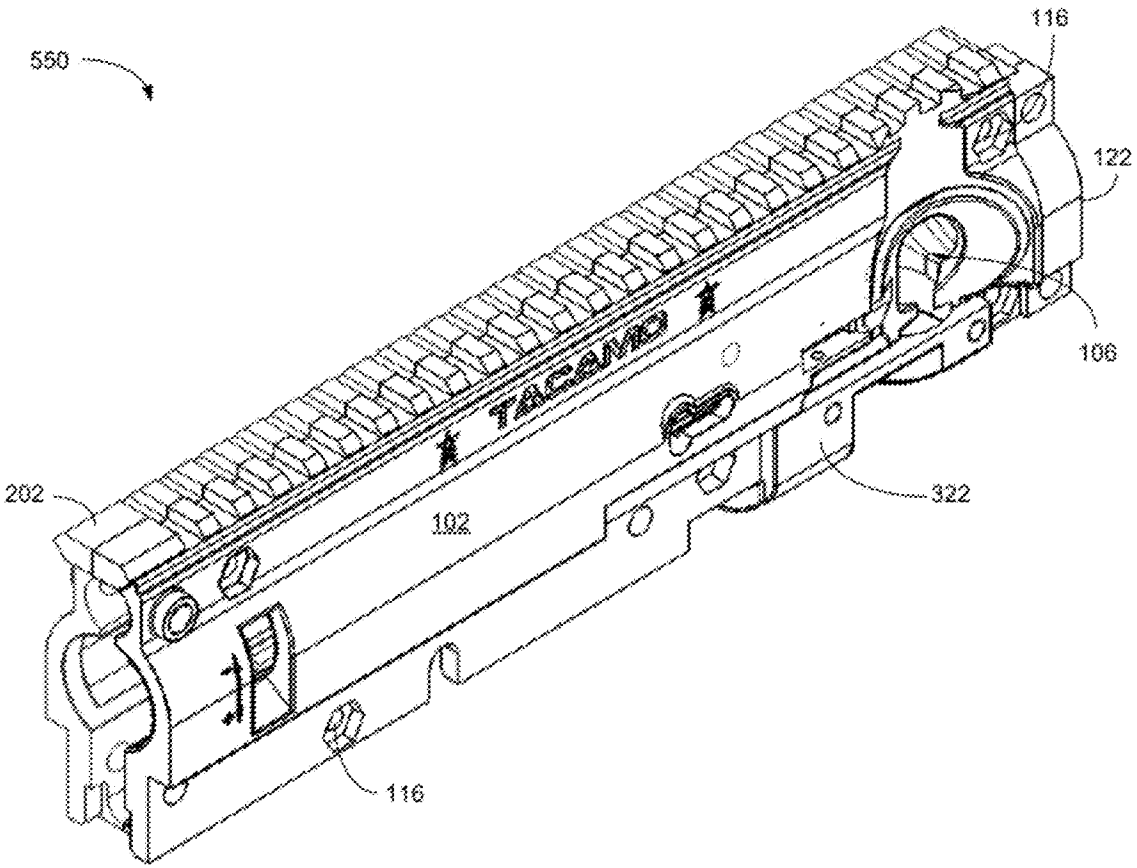

FIGS. 5D-E are 3D diagrams illustrating alternative configurations of a retrofit kit or receiver in accordance with one embodiment of the present invention. Diagrams 548-550 shows retrofit receivers with slightly different dimensions which will be able to retrofit with various different traditional paintball markers. Note that receivers shown in diagram 548-550 include bottom feed adapter 322 which facilitates to receive paintballs from the bottom feed mechanism via bottom feed port 112. Alternatively, receivers illustrated in diagram 548-550 are also able to receive paintballs from the top feed mechanism via top feed port 106.

Figure 6:
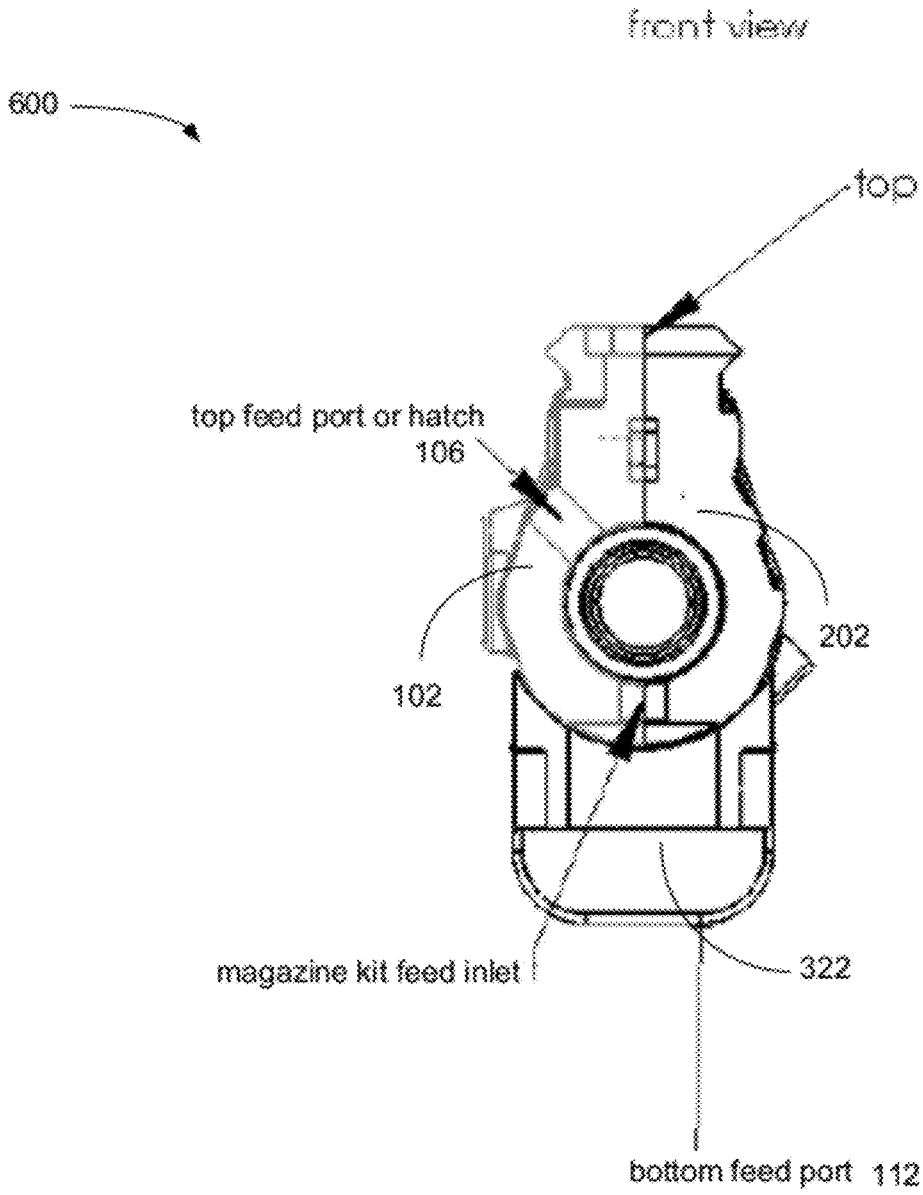
FIG. 6 is a diagram illustrating a front view a receiver showing a top feed port and a bottom feed adapter in accordance with one embodiment of the present invention.

FIG. 6 is a diagram 600 illustrating a front view a receiver showing a top feed port 106 and a bottom feed adapter 322 in accordance with one embodiment of the present invention. The receiver includes a right side receiver 102, a left side receiver 202, and a bottom feed adapter 322. In one embodiment, the receiver also shows a top feed hatch 106 and a bottom feed port 112. When the bottom feed mechanism is not elected, an alternative bottom adapter, which may include in a kit, may be used to seal the bottom feed port or opening.

An advantage of employing the disclosed embodiments of retrofit kit is to allow a paintball operator to pick and choose whether the paintballs should be fed from top, bottom, or both. For example, embodiments of the present invention allow existing paintball guns to be retrofitted to accept a bottom feed paintball mechanism. The existing paintball guns may include, but not limited to, Tippmann 98™, Tippmann A5™, Tippmann X7™ Tippmann X7 Phenom™, BT Combat™, BT Delta™, BT SWAT™, BT4™, US Army Alpha Black™, US Army Project Salvo™, US Army Carver One™, and Valken SW-1™.

In one embodiment, a retrofit assembly for a paintball propelling device includes a first solid side, a second solid side, and a third removable solid side. The first solid side includes a first feed hatch configured to receive paintballs through a first feeding mechanism. The retrofit assembly, in one embodiment, further includes a first grip portion couple to the first solid side for gripping. The first solid side is a right side portion of a receiver capable of catapulting a paintball in response to a launching mechanism. The first feed hatch is operable to couple to a feeder elbow capable of receiving paintballs fed by gravitational force. The feeder elbow, for example, is able to couple with a hopper capable of containing multiple paintballs. The hopper is generally situated in such a way that paintballs can be fed to the chamber of receiver via gravity.

The second solid side is coupled to the first solid side to form a receiver which is further configured to couple with a barrel. The retrofit assembly may further include a second grip couple to the second solid side for gripping. The second solid side is a left side portion of the receiver capable of catapulting a paintball in response to a launching mechanism. The first and second solid sides can be fabricated by aluminum, zinc, alloy, composite materials, or pressure resistance plastics. The first feeding mechanism includes a hopper situated approximately above the receiver and feeds paintballs to the receiver with a gravitational force. The second feeding mechanism includes a magazine situated approximately below the receiver and pushes paintballs in a direction opposite of gravity to the receiver for launching.

The third removable solid side coupled to the receiver and capable of facilitating to receive paintballs via a second feeding mechanism. The assembly of claim 1, wherein a third removable solid side is a bottom feed adapter, wherein the bottom feed adapter is able to couple to a bottom feed magazine. The third removable solid side can also be made by aluminum, zinc, alloy, composite materials, and/or pressure resistance plastics. In one aspect, the bottom feed magazine generates a loading force to push a paintball in a direction against gravity into the receiver for launching the paintball. The third removable solid side includes an optical light emitting component capable of providing a light signal(s) in accordance with firing a paintball from the receiver.

It should be noted that the exemplary embodiments of the present invention disclose a retrofit kit having a receiver capable of facilitating top and bottom feed systems. The receiver can be formed by three (3) separate components, namely a right side receiver 102, a left side receiver 202, and a bottom feed adapter 322 as illustrated above. The receiver, however, does not have to be formed by three (3) components. For example, depending on the applications, the receiver may be formed by one (1) or two (2) components. In an exemplary embodiment, a receiver may be formed by two (2) components, such as a top half receiver and a bottom half receiver wherein the bottom half receiver containing a bottom feed port. Alternatively, a receiver having a top feed hatch and a bottom feed port may be manufactured with one (1) single fabrication process. It should be further noted that the receiver for retrofitting can also be formed with more than three (3) components.

The retrofit assembly further includes a feed switch coupled to the receiver and configured to selectively switch between the first feeding mechanism and the second feeding mechanism. In addition, the receiver is able to couple to a compressed air tank used to propel a paintball into a trajectory.

An advantage of using the embodiments of the present invention is to allow an operator to have a clear line of fire without obstruction such as a hopper.

Figure 7:
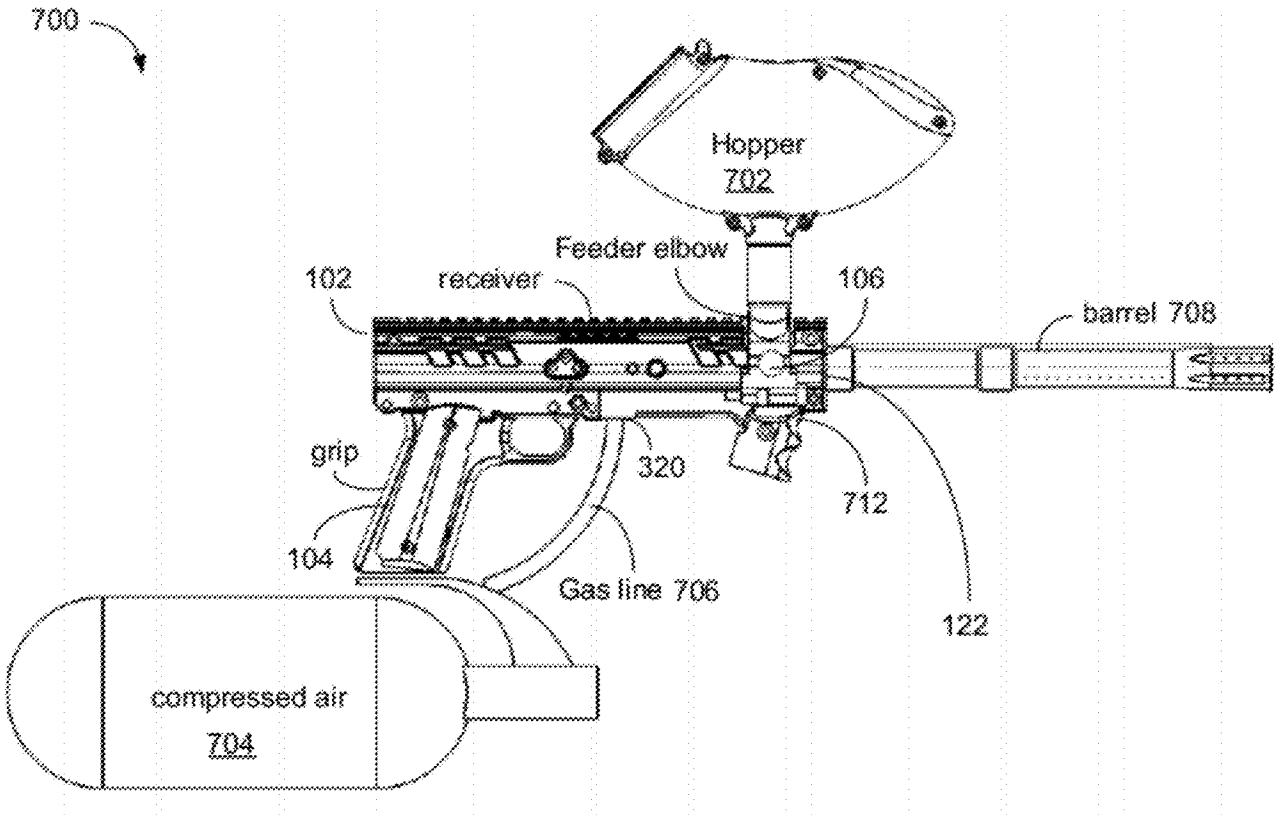
FIG. 7 is a diagram showing a portion of paintball marker being retrofitted with a receiver mounted with a bottom feed adapter in accordance with one embodiment of the present invention.

FIG. 7 is a diagram 700 showing a portion of paintball marker being retrofitted with a receiver mounted with a bottom feed adapter in accordance with one embodiment of the present invention. Diagram 700 includes a receiver, a feeder elbow, a hopper 702, a compressed air container 704, a barrel 708, and a gas line 706. The receiver further includes a right side receiver 102, a right side grip portion 104 wherein the receiver is able to couple to hopper 702 using the feeder elbow via top feed hatch 106. In this embodiment, an alternative bottom adapter 712 is used to block the bottom feed mechanism. Alternative bottom adapter 712 can be optionally replace with a bottom feed adapter if the operator elects to use the bottom feed mechanism. It should be noted that the underlying concept of the exemplary embodiment(s) of the present invention would not change if one or more components (or elements) were added to or removed from diagram 700.

Figure 8:
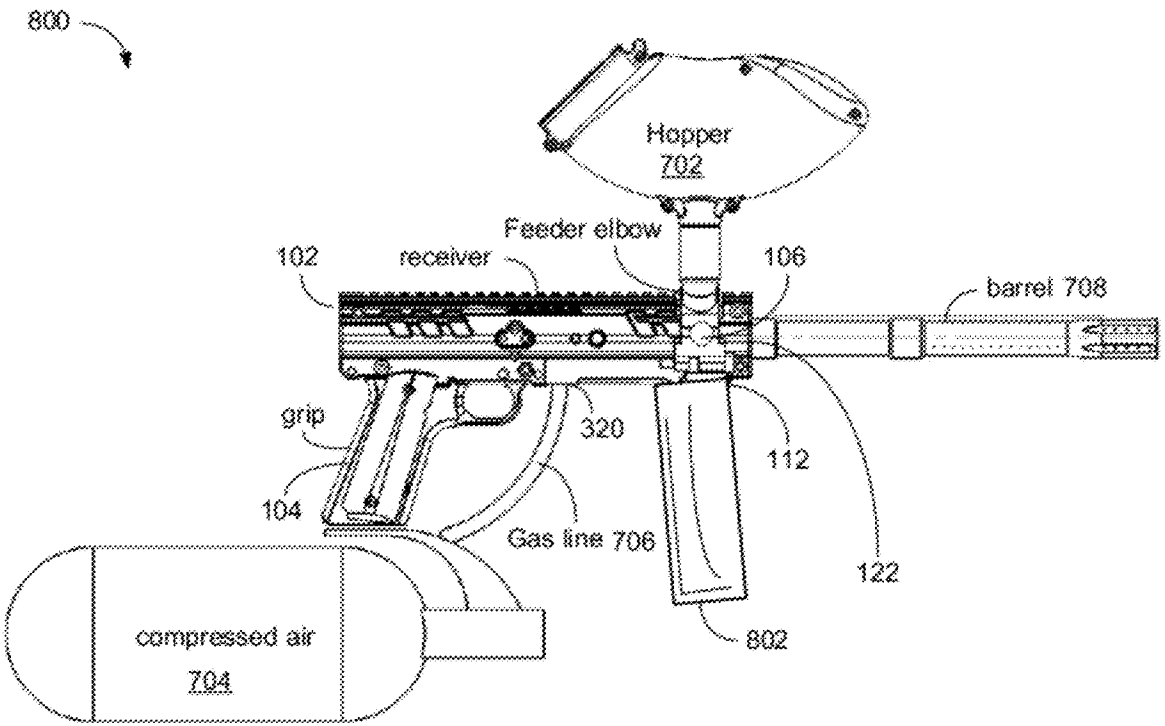
FIG. 8 is a diagram showing a portion of paintball marker being retrofitted with a receiver capable of providing optional loading mechanisms in accordance with one embodiment of the present invention.

FIG. 8 is a diagram 800 showing a portion of paintball marker being retrofitted with a receiver capable of providing optional loading mechanisms in accordance with one embodiment of the present invention. Diagram 800 includes a receiver, a feeder elbow, a hopper 702, a compressed air container 704, a barrel 708, a gas line 706, and a bottom feed magazine 802. A paintball marker operator elects to use both top feed mechanism and bottom feed mechanism. In one embodiment, bottom feed magazine 802 couples to a bottom feed adapter and feeds paintballs to the chamber of receiver via bottom feed port 112. It should be noted that the underlying concept of the exemplary embodiment(s) of the present invention would not change if one or more components (or elements) were added to or removed from diagram 800.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A retrofit assembly for a paintball propelling device comprising:

a first solid side having a first feed hatch configured to receive a plurality of paintballs through a first feeding mechanism;

a second solid side coupled to the first solid side to form a receiver configured to couple with a barrel; and a third removable solid side coupled to the receiver and capable of facilitating to receive paintballs via a second feeding mechanism.

2. The assembly of claim 1, further comprising a first grip portion couple to the first solid side for gripping.

3. The assembly of claim 2, further comprising a second grip couple to the second solid side for gripping.

4. The assembly of claim 1, wherein a first solid side having a first feed hatch is a right side portion of the receiver capable of catapulting a paintball in response to a launching mechanism.

5. The assembly of claim 4, wherein a first solid side having a first feed hatch is fabricated by one of aluminum, zinc, alloy, composite materials, and pressure resistance plastics.

6. The assembly of claim 1, wherein the first feed hatch is operable to couple to a feeder elbow capable of receiving paintballs fed by gravitational force.

7. The assembly of claim 6, wherein the feeder elbow is able to couple with a hopper capable of containing a plurality of paintballs, wherein the hopper is situated in such a way that the plurality of paintballs is fed to the receiver by gravitational force.

8. The assembly of claim 1, wherein a second solid side is a left side portion of the receiver capable of catapulting a paintball in response to a launching mechanism.

9. The assembly of claim 8, wherein a second solid side is fabricated by one of aluminum, zinc, alloy, composite materials, and pressure resistance plastics.

10. The assembly of claim 1, wherein a third removable solid side is a bottom feed adapter, wherein the bottom feed adapter is able to couple to a bottom feed magazine.

11. The assembly of claim 10, wherein a third removable solid side is made by one of aluminum, zinc, alloy, composite materials, and pressure resistance plastics.

12. The assembly of claim 11, wherein the bottom feed magazine generates a loading force to push a paintball in a direction against gravity into the receiver for launching the paintball.

13. The assembly of claim 1, wherein the receiver is capable of coupling to a compressed air tank utilized to propel a paintball into a trajectory.

14. The assembly of claim 1, wherein a third removable solid side includes an optical light emitting component capable of providing light signal in accordance with firing a paintball from the receiver.

15. The assembly of claim 1, wherein the first feeding mechanism includes a hopper situated approximately above the receiver and feeds paintballs to the receiver with a gravitational force; and wherein the second feeding mechanism includes a magazine situated approximately below the receiver and pushes paintballs a direction opposite of gravity to the receiver for launching.

16. The assembly of claim 1, further comprising a feed switch coupled to the receiver and configured to selectively switch between the first feeding mechanism and the second feeding mechanism.

17. A retrofit kit for a paintball gun comprising:

a right side portion of a receiver having a first feed hatch able to receive a plurality of paintballs through an upper loading mechanism;

a left side portion of the receiver coupled to the right side portion of the receiver configured to couple to a barrel; and a bottom removable adapter coupled to the receiver and capable of facilitating to receive paintballs via a bottom feeding mechanism.

18. The assembly of claim 1, further comprising a right grip portion coupled to the right side portion of the receiver and a left grip portion coupled to the left side portion of the receiver for gripping.

19. A retrofit kit for a paintball gun comprising:

a bottom feed magazine containing a plurality of paintballs; and a receiver having a top feed port and a bottom feed port wherein the top feed port is able to receive paintballs through an upper loading mechanism and a bottom feed port is capable of receiving a plurality of paintballs via the bottom feed magazine.

20. The assembly of claim 1, further comprising a hopper coupled to the receiver and containing paintballs capable of feeding the paintballs into the receiver via gravitational force.

* * * * *

UNITED STATES PATENT AND TRADEMARK OFFICE

CERTIFICATE OF CORRECTION

PATENT NO. : 8,166,961 B2
APPLICATION NO. : 12/882190
DATED : May 1, 2012
INVENTOR(S) : Omar Alonso Macy It is certified that error appears in the above-identified patent and that said Letters Patent is hereby corrected as shown below:

Title Page, item (73);
In the ASSIGNEE, replace “RAPU” with “RAP4”.

Signed and Sealed this
Nineteenth Day of June, 2012

David J. Kappos

David J. Kappos
*Director of the United States Patent and Trademark Office*